United States Patent [19]

Uemura et al.

[11] 4,440,624

[45] Apr. 3, 1984

[54] STARTING PITCHES FOR CARBON FIBERS

[75] Inventors: Seiichi Uemura, Tokyo; Shunichi Yamamoto; Takao Hirose, both of Kamakura; Hiroaki Takashima, Kawasaki; Osamu Kato, Yokohama, all of Japan

[73] Assignee: Nippon Oil Co., Ltd., Tokyo, Japan

[21] Appl. No.: 435,617

[22] Filed: Oct. 20, 1982

[30] Foreign Application Priority Data

Oct. 23, 1981 [JP] Japan ..... 56-168606

[51] Int. Cl.[3] ..... C10C 3/00; C01B 31/02

[52] U.S. Cl. ..... 208/22; 208/39; 423/447.2; 423/447.4; 423/447.6

[58] Field of Search ..... 208/22, 39; 423/447.2, 423/447.4, 447.6, 448, 449

[56] References Cited

U.S. PATENT DOCUMENTS

| | | | |
|---|---|---|---|
| 2,770,577 | 11/1956 | Stossel | 208/39 |
| 3,128,241 | 4/1964 | Podlipnic et al. | 208/41 |
| 3,453,226 | 7/1969 | Corbett | 208/45 |
| 3,607,672 | 9/1971 | Schmitt | 423/447.4 |
| 3,639,953 | 2/1972 | Kimura et al. | 423/447.6 |
| 3,784,679 | 1/1974 | Chiche | 423/447.6 |
| 3,852,428 | 12/1974 | Powell et al. | 423/447.6 |
| 4,070,446 | 1/1978 | Horikiri et al. | 423/447.4 |
| 4,155,833 | 5/1979 | Gleim | 208/309 |
| 4,177,132 | 12/1979 | Uemura et al. | 208/22 |
| 4,271,006 | 6/1981 | Dickakian | 208/44 |

OTHER PUBLICATIONS

*Chemical Dictionary,* Hackh's, pp. 721–722, 4 Edition Ed. Julius Corant, McGraw Hill.

*Chemical Technology of Petroleum,* "Petroleum Waxes", 3rd Ed. Grise & Stevens, McGraw Hill, 1960, Chap. XIV, pp. 550–579.

*Primary Examiner*—Delbert E. Gantz
*Assistant Examiner*—Helane E. Maull
*Attorney, Agent, or Firm*—Bucknam and Archer

[57] ABSTRACT

A starting pitch for carbon fibers, obtained by mixing (1) a heavy fraction oil boiling at not lower than 200° C. obtained at the time of steam cracking of petroleum with (2) wax and then heat treating the resulting mixture at a specified temperature and pressure thereby to obtain the starting pitch, the thus obtained starting pitch being heat treated to produce a precursor pitch which is melt spun, infusibilized, carbonized or graphitized to obtain the carbon fibers.

6 Claims, No Drawings

STARTING PITCHES FOR CARBON FIBERS

This invention relates to an excellent pitch for producing carbon fibers therefrom.

There was recently reported a method for producing carbon fibers having improved tensile modulus and tensile strength, which comprises heat treating a commercially available petroleum pitch to obtain a pitch containing optically anisotropic liquid crystals called "mesophase" (such a pitch being hereinafter referred to as "precursor pitch" in the melt spinning step), melt spinning the thus obtained precursor pitch, infusibilizing (making infusible) the thus melt spun pitch and then carbonizing or graphitizing the pitch so infusibilized (Japanese Pat. Appln. Laid-Open Gazette No. 49-19127).

However, it depends on various factors whether or not pitch may form liquid crystal therein. In addition, the resulting liquid crystals will greatly depend for their structure, softening point, viscosity and other properties on the pitch used as the starting material. The Japanese Laid-Open Gazette No. 49-19127 discloses a method for producing a pitch containing the mesophase (such a pitch being hereinafter called "mesophase pitch"), however, it does not describe a starting pitch for producing a mesophase pitch of good quality therefrom. As mentioned before, it depends greatly on a starting pitch whether or not a mesophase pitch of good quality may be obtained therefrom. If a very desirable starting pitch is obtained, then it will be possible to produce therefrom carbon fibers having excellent tensile modulus and strength. Therefore, it is an important object of this invention to provide such a very desirable starting pitch.

For example, coal tar pitch contains quinoline-insoluble and infusible substances, and these undesirable substances cause the non-uniformity of the precursor pitch thus not only degrading the spinnability of the precursor pitch but also having adverse effects on the strength and tensile modulus of the resulting carbon fibers.

In contrast, commercially available petroleum pitches and ethylene bottom oils hardly contain any quinoline-insoluble and infusible substances, however, they will produce quinoline-insoluble high molecular weight substances when heat treated to prepare a precursor pitch therefrom. More particularly, when these pitches are heat treated, they will cause both thermal decomposition and polycondensation so that the low molecular weight ingredients gradually form quinoline-insoluble high molecular weight substances. Further, the high molecular weight ingredients so formed will, in turn, form further high molecular weight ones which are infusible.

The presence of these infusible substances will cause the clogging of nozzles and the tearing-off of the resulting fibers in the melt spinning step whereby continuous spinning in rendered impossible.

Even if the petroleum pitches and ethylene bottom oils are treated under mild conditions to inhibit the generation of the infusible substances therefrom, they will form a mixture of an optically anisotropic component and a non-anisotropic component. The differences in melting properties between these two components cause frequent tearing-off of fibers or make the surface thereof inferior in smoothness and, therefore, the petroleum pitches and bottom oils cannot be said to be desirable ones for producing fibers.

The present inventors made intensive studies in an attempt to obtain such an excellent pitch and, as a result of their studies, they obtained an excellent pitch. More particularly, they found a starting pitch which will inhibit the production of high molecular weight ingredients and have the most suitable viscosity in the step of preparing precursor pitches and which will be able to have a composition allowing the aromatic planes to be easily arranged in order at the initial stage in the carbonization step. In other words, this invention has its object to provide starting pitches which eliminate the undesirable drawbacks of the conventional starting pitches for producing carbon fibers and will easily produce therefrom precursor pitch having excellent spinnability.

The starting pitches of this invention which may be used in a method comprising heat treating a starting pitch to obtain a precursor pitch, melt spinning the thus obtained precursor pitch, infusibilizing the thus spun pitch, carbonizing the thus infusibilized pitch and, if desired, graphitizing the thus carbonized pitch to obtain carbon fibers, may be produced by a method comprising mixing 100 parts by weight of (1) a heavy fraction oil boiling at not lower than 200° C. obtained at the time of steam cracking of petroleum with 10–200 parts by weight of (2) wax to obtain a mixture and then heat treating the thus obtained mixture at a temperature of 360°–480° C. and a pressure of 2–50 $Kg/cm^2.G$.

In cases where the starting pitches of this invention are subjected to mesophase-forming reaction, it was quite unexpectedly found that the production of quinoline-insoluble and infusible ingredients was inhibited, the pitch was reformed and the resulting final product, carbon fibers, had further high tensile modulus and high tensile strength.

In contrast, commercially available pitches or ethylene tar pitch were heat treated in an attempt to carry out mesophase formation in accordance with the method disclosed in Japanese Pat. Appln. Laid-Open Gazette No. 49-19127 so as to obtain heat treated pitches. For example, some of the thus heat treated pitches had a softening point of 340° C. or higher, some thereof contained solid matter deposited therein and some thereof contained at least 70 wt.% of quinoline-insoluble and infusible ingredients although they contained no solid matter deposited therein; it is practically impossible in many cases to melt spin these heat treated pitches. Some of these heat treated pitches, which happened to be able to be melt spun, were then infusibilized, carbonized and graphitized to obtain carbon fibers having a tensile strength of as low as 100–150 $Kg/mm^2$ and a tensile modulus of as low as about 12–20 $ton/mm^2$.

The heavy fraction oil boiling at not lower than 200° C. obtained at the time of steam cracking of petroleum according to this invention is a heavy fraction oil boiling at substantially 200°–450° C. obtained as a by-product at the time of steam cracking at usually 700°–1200° C. of petroleum such as naphtha, kerosene or light oil to produce therefrom olefins such as ethylene and propylene.

The wax used in this invention includes petroleum wax, natural wax, synthetic wax or a mixture thereof. The petroleum wax includes paraffin wax, microcrystalline wax or petrolatum; the natural wax includes ozocerite; and the synthetic wax includes a low molecular weight polyethylene, atactic polypropylene or an ethylene-propylene copolymer. The wax used in this invention has an average molecular weight of preferably 250–1000, more preferably 300–500.

As previously mentioned, the starting pitch of this invention may be obtained by mixing in a specific ratio (1) a heavy fraction oil boiling at not lower than 200° C. obtained at the time of steam cracking of petroleum with (2) wax to form a mixture and then heat treating the thus obtained mixture under specific conditions.

It is necessary that the component (1) and the component (2) be mixed together in a mixing ratio by weight of 1:0.1–2, preferably 1:0.2–1.5. The heat treating temperature is in the range of 360°–480° C., preferably 390°–460° C. The heat treatment at lower than 360° C. will allow the reaction to proceed slowly and take a long time to complete the reaction, this being economically disadvantageous. The heat treatment at higher than 480° C. will undesirably raise problems as to coking and the like. The heat treating time will be determined in view of the heat treating temperature; a long time is necessary for the low treating temperature, while a short time for the high treating temperature. The heat treating time may be in the range of usually 15 minutes to 20 hours, preferably 30 minutes to 10 hours. The heat treating pressure is not particularly limited but preferably such that the effective ingredients of the mixture and not distilled off without reaction from the system. Thus, the pressure may actually be in the range of 2–50 Kg/cm$^2$.G, preferably 5–30 Kg/cm$^2$.G.

The starting pitches obtained by the heat treatment may preferably be subjected to distillation or the like to remove the light fraction therefrom if necessary.

The thus obtained pitches of this invention may be heat treated to prepare precursor pitches thereof while inhibiting the formation of quinoline-insoluble and infusible high molecular weight ingredients, thus obtaining satisfactory precursor pitches having a composition wherein the aromatic planes are easily arranged in order. Thus, the precursor pitches so obtained may be used in producing carbon fibers having very excellent tensile modulus and tensile strength.

The starting pitches of this invention may be used in producing carbon fibers by the use of a conventional known method. More particularly, the starting pitch is heat treated to prepare a precursor pitch, after which the precursor pitch so obtained is melt spun, infusibilized and carbonized or further graphitized to obtain carbon fibers.

The heat treatment of the starting pitch to obtain a precursor pitch may usually be carried out at 340°–450° C., preferably 370°–420° C., in the stream of an inert gas such as nitrogen under atmospheric or reduced pressure. The time for the heat treatment may be varied depending on the heat treating temperature, the flow rate of the inert gas, and the like, however, it may usually be 1–50 hours, preferably 3–20 hours. The flow rate of the inert gas may preferably be 0.7–5.0 scfh/lb pitch.

The method of melt spinning the precursor pitch may be a known method such as an extrusion, centrifugal or spraying method.

The pitch fibers obtained by melt spinning the starting pitch are then infusibilized in an oxidizing atmosphere. The oxidizing gases which may usually be used herein, include oxygen, ozone, air, nitrogen oxides, halogen and sulfurous acid gas. These oxidizing gases may be used singly or in combination. The infusibilizing treatment may be effected at such a temperature that the pitch fibers obtained by melt spinning are neither softened nor deformed; thus, the infusibilizing temperature may be, for example, 20°–360° C., preferably 20°–300° C. The time for the infusibilization may usually be in the range of 5 minutes to 10 hours.

The pitch fibers so infusibilized are then carbonized or further graphitized to obtain carbon fibers. The carbonization may usually be carried out at 800°–2500° C. for generally 0.5 minutes to 10 hours. The further graphitization may be carried out at 2500°–3500° C. for usually 1 second to 1 hour.

Further, the infusibilization, carbonization or graphitization may be effected with some suitable load or tension being applied to the mass to be treated in order to prevent the mass from shrinkage, deformation and the like.

This invention will be better understood by the following non-limitative examples and comparative examples.

EXAMPLE 1

Eighty (80) parts by weight of a heavy fraction oil (having distillation characteristics as shown in Table 1) boiling at not lower than 200° C. produced as a by-product at the time of steam cracking of naphtha at 830° C. were mixed with 20 parts by weight of petroleum wax (145° F. paraffin wax) to form a mixture which was then heat treated at 430° C. under a pressure of 20 Kg/cm$^2$.G for 3 hours. The thus heat treated oil was distilled at 250° C. under a pressure of 1.0 mmHg to remove the light fraction therefrom thereby obtaining a starting pitch of this invention having a softening point of 80° C. and containing 10.6 wt.% of benzene-insoluble ingredients.

Then, 30 g of the thus obtained starting pitch were heat treated at 400° C. under agitation for 10 hours while blowing nitrogen thereto at a flow rate of 600 ml/min. thereby to obtain a pitch having a softening point of 290° C. and containing 34 wt.% of quinoline-insoluble ingredients and 85% of mesophase. This pitch was melt spun at 355° C. by the use of a spinner having 0.3 mm-diameter nozzles and L/D=2 to obtain pitch fibers of 13–16μ in diameter which were then infusibilized, carbonized and graphitized to obtain carbon fibers.

The infusibilization, carbonization and graphitization were carried out under the following conditions.

Infusibilizing conditions: Raised at 3°C./min. to 200° C., then at 1° C./min. to 300° C. and maintained at 300° C. for 15 minutes in air.

Carbonizing conditions: Raised at 5° C./min. to 1000° C. and maintained at this temperature for 30 minutes in a nitrogen atmosphere.

Graphitizing conditions: Raised at 25° C./min. to 2500° C. for heat treatment in an argon stream.

The carbon fibers so obtained had a tensile strength of 180 Kg/mm$^2$ and a tensile modulus of 30 ton/mm$^2$.

TABLE 1

| Distillation Characteristics of Heavy Fraction Oil | | |
|---|---|---|
| Specific gravity (15° C./4° C.) | | 1.039 |
| Distillation Characteristics | Initial point | 192 (°C.) |
| | 5% | 200 |
| | 10% | 206 |
| | 20% | 217 |
| | 30% | 227 |
| | 40% | 241 |
| | 50% | 263 |
| | 60% | 290 |
| | 70% | 360 |

COMPARATIVE EXAMPLE 1

The same heavy fraction oil as used in Example 1 was heat treated at 400° C. under a pressure of 15 Kg/cm$^2$.G for 3 hours. The thus heat treated oil was distilled at 250° C. under a pressure of 1.0 mmHg to distil off the light fraction therefrom thereby obtaining a starting pitch having a softening point of 82° C.

The thus obtained starting pitch was then heat treated in the same manner as in Example 1 to obtain a pitch having a softening point of 318° C. and containing 59 wt.% of quinoline-insoluble ingredients and 97% of mesophase. This pitch was melt spun at 368° C. by the use of the spinner used in Example 1 to obtain pitch fibers of 18–24$\mu$ in diameter which were infusibilized, carbonized and graphitized to obtain carbon fibers having a tensile strength of 110 Kg/mm$^2$ and a tensile modulus of 14 ton/mm$^2$.

EXAMPLE 2

Eighty (80) parts by weight of the same heavy fraction oil as used in Example 1 were mixed with 20 parts by weight of polyethylene wax to form a mixture which was then heat treated at 430° C. under a pressure of 20 Kg/cm$^2$.G for 3 hours. The thus heat treated oil was distilled at 250° C. under a reduced pressure of 1.0 mmHg to distil off the light fraction thereby to obtain a starting pitch of this invention having a softening point of 75° C.

The thus obtained starting pitch was heat treated in the same manner as in Example 1 to obtain a precursor pitch having a softening point of 295° C. and containing 35 wt.% of quinoline-insoluble ingredients and 90% of mesophase. This precursor pitch was melt spun at 360° C. by the use of the spinner used in Example 1 to obtain pitch fibers of 13–$\int\mu$ in diameter which were then infusibilized, carbonized and graphitized in the same manner as in Example 1 to obtain carbon fibers. The thus obtained carbon fibers had a tensile strength of 190 Kg/mm$^2$ and a tensile modulus of 32 ton/mm$^2$.

What is claimed is:

1. A starting pitch for carbon fibers, obtained by mixing 100 parts by weight of (1) a heavy fraction oil boiling at not lower than 200° C. obtained at the time of steam cracking of petroleum with (2) 10–200 parts by weight of wax having an average molecular weight of 250–1000 to form a mixture and then heat treating the thus obtained mixture at 360°–480° C. under a pressure of 2–50 Kg/cm$^2$.G thereby to obtain the starting pitch for carbon fibers, the starting pitch so obtained being heat treated to produce a precursor pitch which is melt spun, infusibilized, carbonized or graphitized to obtain the carbon fibers.

2. A starting pitch according to claim 1, wherein the heavy fraction oil (1) and the wax (2) are mixed together in a mixing ratio by weight of 1:0.1–2.

3. A starting pitch according to claim 1 or 2, wherein the wax is at least one member selected from the group consisting of paraffin wax, microcrystalline wax, petrolatum, ozocerite, low molecular weight polyethylene, atactic polypropylene and ethylene-propylene copolymers.

4. The starting pitch according to claim 1 wherein said heavy fraction oil has a boiling point of 200°–450° C. and is obtained as a by-product at the time of steam cracking naphtha, kerosene or light oil at 700°–1200° C.

5. The starting pitch according to claim 4 wherein said mixture is heated in a stream of an inert gas.

6. The starting pitch according to claim 1 wherein said mixture is heated for 3–20 hours.

* * * * *